United States Patent [19]

Andersson

[11] 4,345,577

[45] Aug. 24, 1982

[54] SPRING TYPE APPARATUS FOR PROJECTING BALLS

[76] Inventor: Uno K. T. Andersson, Ullstorp P.B. 3287, Vinslöv, Sweden, S-280-13

[21] Appl. No.: 169,115

[22] PCT Filed: Feb. 26, 1979

[86] PCT No.: PCT/SE79/00040

§ 371 Date: Oct. 27, 1979

§ 102(e) Date: Sep. 28, 1979

[87] PCT Pub. No.: WO79/00665

PCT Pub. Date: Sep. 6, 1979

[30] Foreign Application Priority Data

Feb. 27, 1978 [SE] Sweden ..... 7802182

[51] Int. Cl.[3] ..... F41B 7/00

[52] U.S. Cl. ..... 124/16; 124/41 R; 124/36; 124/34; 273/411

[58] Field of Search ..... 124/17, 16, 36, 41 R, 124/82; 273/26 D, 411

[56] References Cited

U.S. PATENT DOCUMENTS

| | | | |
|---|---|---|---|
| 3,602,208 | 11/1967 | Huerlimann | 124/41 R X |
| 3,807,379 | 4/1974 | Vodinh | 273/260 X |
| 3,878,828 | 4/1975 | Francesco | 124/16 |
| 4,122,822 | 10/1978 | Scheiwiller | 124/54 |

FOREIGN PATENT DOCUMENTS

| | | |
|---|---|---|
| 2134616 | 4/1972 | Fed. Rep. of Germany . |
| 1284682 | 1/1962 | France . |

*Primary Examiner*—Richard C. Pinkham
*Assistant Examiner*—William R. Browne
*Attorney, Agent, or Firm*—Ladas & Parry

[57] ABSTRACT

Apparatus for projecting balls, having an impact device (10) supported in a frame (11) and provided to convey to a ball an impulse in a direction of projection (Z) from a position in the frame. The frame (11) is supported in a frame work (30) for movement around a vertical axis (X) and a horizontal axis (Y). First and second motor (M1) and (M2) respectively, are provided to rotate the frame (11) around its vertical axis (X) and its horizontal axis (Y) respectively. The rotation being a two way movement over adjustable angular arcs. A controller (27, 27', 28, 28', 45, 46) is arranged for controlling the movement of the frame (11) around the vertical axis (X) and the horizontal axis (Y). The controller comprises limit switches (27, 27', 28, 28') which are manually displacable, a control system (46) having adjustable limiter (A–F) for limiting the movement of the frame (11), or an adjuster (45) for adjusting a sequence of predetermined directions for the frame (11).

10 Claims, 5 Drawing Figures

SPRING TYPE APPARATUS FOR PROJECTING BALLS

TECHNICAL FIELD

The present invention relates to an apparatus for automatic projecting balls, preferably footballs, which apparatus includes an impact device supported in a frame and provided to convey to a ball an impulse in a direction of projection for projection thereof from a position of projection in the frame, the frame being supported in a framework for movement around a vertical axis and a horizontal axis.

In training ball players, e.g. football players, it is in several occasions desirable to deliver a ball to a desired area of the field. Thus, in training of the goalkeeper and in training continued game in connection with kicks at goal (crosses) as well as corner kicks a player is all the time retained for kicking the ball. The effect of the training is highly dependent on the degree of accuracy this player can deliver the ball to the desired area of the field.

PRIOR ART

Prior art apparatus for projecting balls are described in British Pat. Nos. 1,363,146, 1,188,498 and 466,781.

These prior art apparatus for projecting balls all have the drawback that the direction of projection cannot be adjusted to any greater accuracy. Moreover, as soon as the direction of projection is to be changed an operator has to manually either move the entire apparatus or change an adjustment device for the direction of projection.

PURPOSE OF THE INVENTION

The purpose of the invention is to achieve an apparatus for automatic projecting balls, which apparatus with great accuracy permits projection of balls in sequence in different directions without requiring any intermediate, manual adjustment of the apparatus.

This purpose is achieved by means of an apparatus having the features mentioned in the introductory part and being distinguished in that first drive means is provided to rotate the frame around its vertical axis in a two-way movement over an adjustable angular arc in horizontal direction, that second drive means is provided for rotating said frame around the horizontal axis in a two-way movement over an adjustable angular arc in vertical direction.

BRIEF DESCRIPTION OF THE DRAWINGS

The invention is described in detail below with reference to the enclosed drawings illustrating preferred embodiments of an apparatus according to the invention.

PREFERRED EMBODIMENTS OF THE INVENTION AND INDUSTRIAL APPLICABILITY

Figure 1:
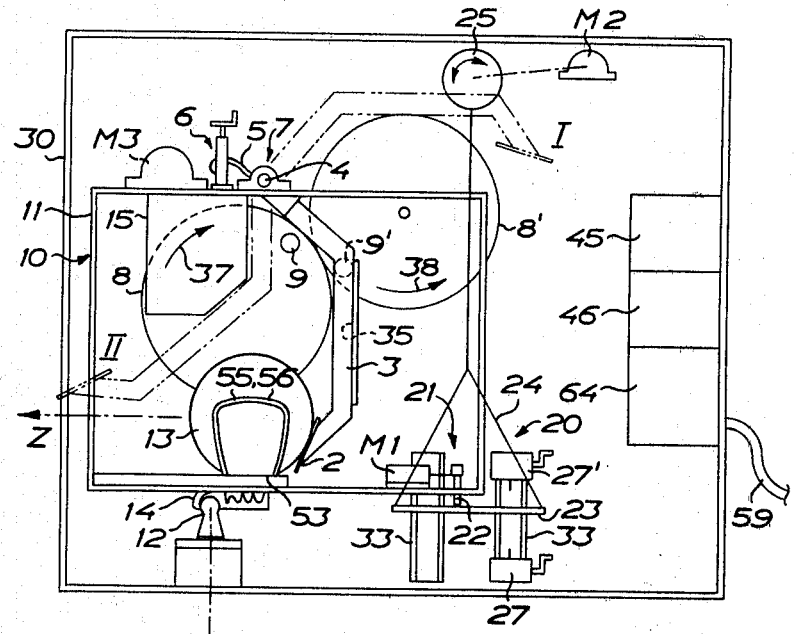
FIG. 1 is a lateral view schematically illustrating a preferred embodiment of the apparatus of the invention having one lateral cover plate removed.
Figure 2:
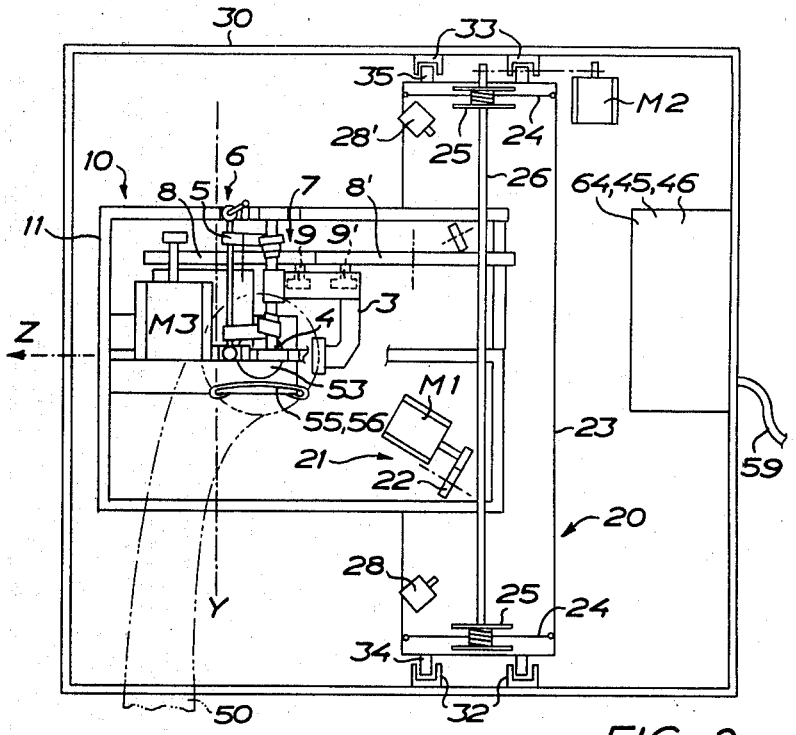
FIG. 2 is a top view schematically illustrating the apparatus of FIG. 1 with its top plate removed.
Figure 3:
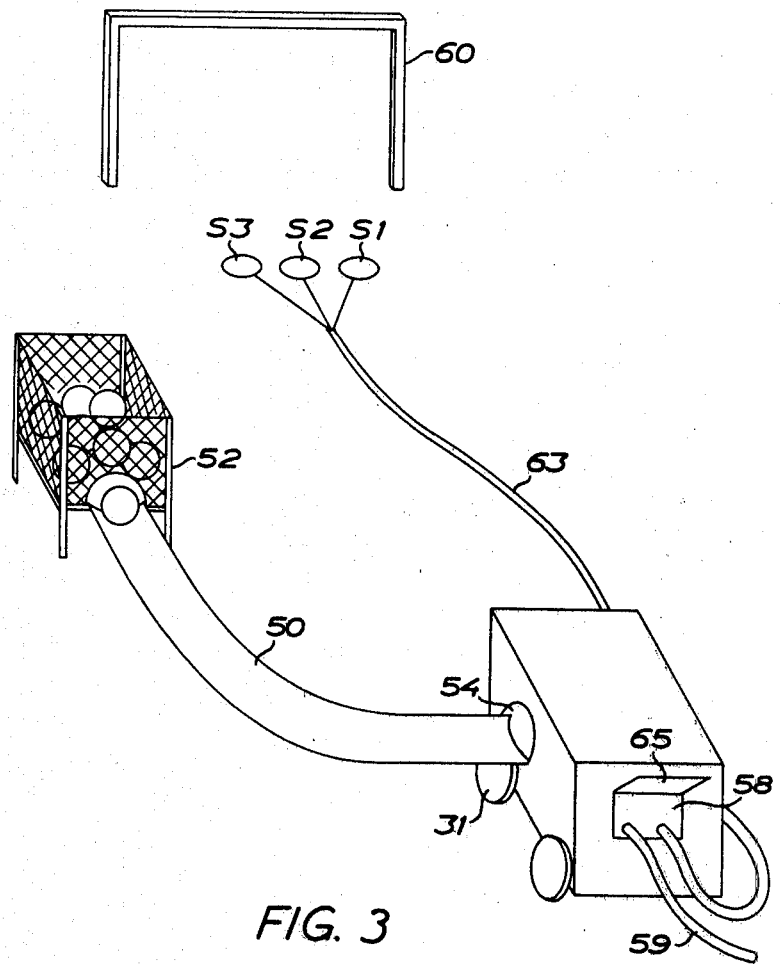
FIG. 3 shows the apparatus according to the invention placed in front of a football goal for the training of a goalkeeper.

The embodiment disclosed in FIGS. 1–3 of the apparatus according to the invention for projecting balls includes an impact device 10 which is provided to convey an impulse to a ball 13 for projecting said ball in a direction of projection Z determined by the direction of the impact device. The impact device is supported on a frame 11 which is movable around two mutually perpendicular axes X and Y, axis Y being substantially horizontal and axis X being substantially vertical.

The direction of projection Z for a ball which is projected by the impact means 10 is determined by a direction adjusting device 20 which is provided to rotate the impact device around either or both of said axes X and Y.

Frame 11 of the impact device together with the direction adjusting device 20 is supported by a framework 30 which includes longitudinal, lateral as well as vertical stiffening beams, several of which are not disclosed on the drawings. Preferably, framework 30 is supported on wheels 31 (FIG. 3) for facilitating simple movement and coarse aiming of the projection apparatus. Moreover, cover plates are fixed to the top and lower portions as well as to the sides of the framework, an opening being defined in the front cover plate for permitting the projection of a ball. A ball feeding device (not shown) for supplying balls is also provided for feeding one ball at the time to the impact device for projection (FIG. 3).

In the illustrated embodiment frame 11 of the impact device is supported on a bearing ball 12 which is mounted on framework 30. A bearing cup 14 fixed to the lower portion of the frame is thus provided that the centre of gravity of impact device 10 with the associated frame lies somewhat behind bearing ball 12. Bearing ball 12 and bearing cup 14 can be comprised of a conventional trailer coupling including spring locking means, the impact device thereby being removable in a simple way from framework 30. However, maintaining its range of movement around two axes perpendicular to the direction of projection Z, frame 11 can also be supported on a clevis having a pivot journalled around axis X. In this case an axle of rotation parallel to said Y-axis is provided between the legs of the clevis, said axle of rotation being journalled in lugs projecting from frame 11.

Direction adjusting device 20 for varying the direction of projection Z of the ball or aiming the impact device 11 includes means for changing the lateral direction of projection (rotation around X-axis) and means for changing the direction of projection in height (rotation around Y-axis).

Said means for changing the lateral direction of projection includes support means 21 at the lower, back portion of frame 11, said support means in the embodiment depicted on the drawings being comprised of two, in relation to the direction of projection laterally spaced, rotatable members 22, such as wheels or rolls, which together with bearing ball 12 steadily supports frame 11 of the impact device in said framework. It is realized that this three-points suspension of said frame can be implemented in several other ways.

Said rotatable members depicted on the drawings as wheels 22 have their axes of rotation directed substantially towards bearing ball 12 and rest on an underlying support 23 shaped as a plate or similar, on which wheels 22 can move in lateral direction substantially along a circular arc. A reversible drive means M1 is connected to at least one rotatable member 22 for driving the same, frame 11 of the impact device 10 being laterally rotatable around the X-axis over a predetermined sector. As mentioned below frame 11 can move laterally between two end positions.

Support 23 which carries wheels 22 is a part of said means for changing the direction of projection in height. Thus, plate 23 which extends laterally of said projection apparatus is suspended for movement in height direction between upper and lower end positions. In the embodiment disclosed said plate is suspended at its short ends by wires 24 which extend upwards and each being fixed to storage drums 25 which are rotatably supported above plate 23. The two drums 25 are connected by means of a shaft 26 which is rotatable in both directions by means of a reversible drive means M2 connected thereto. The connection schematically disclosed by a point and dash line can be structured as for drive means M1 or by means of a belt or a chain. The rotation of drums 25 causes plate 23 to raise or sink, impact device 10 thereby rotating around the horizontal axis Y through bearing ball 12.

For stabilizing the movement of support plate 23 vertical guide tracks 32, 33 are provided on the side walls of framework 30 adjacent the two short ends of the support plate in order to cooperate with pins 34, 35 fixed to the latter one.

Thus, direction adjusting device 20 permits changing of the direction of projection Z within a lateral desired sector or a vertical desired sector. The respective maximum range of these sectors are restricted by the dimensions and the mutual positions of the framework, the direction adjustment means and the components incorporated therein. However, the measure of these angle sectors can be reduced from the respective maximum values in that limit members 27, 27' and 28, 28' which are mounted to mark the end positions of the rotating movement in the height and lateral direction of frame 11, are arranged displaceable towards a respective center position and are fixable in a desired position. Limit members 27, 27' which limit the movement of frame 11 in the height direction, are shown only in FIG. 1 and are fixably disposed in one of the guide tracks 33. Limit members 28, 28' which limit the lateral movement of frame 11, are shown only in FIG. 2 and are fixably arranged on support plate 23 in a guide track not shown.

These limit members are comprised of switches which are connected to a control system 45, 46 for the projection apparatus and are thus provided that they upon actuation initiate a reversion of the direction of operation of the associated drive means. Thus, within the scope of the control system switches 27 and 27' are connected to drive means M2, while switches 28 and 28' are connected to drive means M1. The control system 45, 46 which can be embodied in a great number of ways is arranged adjacent a junction box 64 and is accessible from the outside through a door 65.

Impact device 10 includes an impact arm 3 which is rotatably supported on a horizontal shaft 4, and a cooking device 7 having spring means 5 connected to the impact arm. Cocking device 7 is arranged to convey impact arm 3, against the action of spring means 5, to an extended position I, in which this arm after release and under action of the energy stored in said spring means swings back and in its striking movement hits ball 13 and projects the same in adjusted direction of projection Z.

In the illustrated embodiment said spring means is comprised of two powerful coil springs coupled between shaft 4 and spring bias means 6. Spring bias means 6 is disclosed for manual operation by means of a handle, but can also be connected to a drive means for variation of the spring bias without manual manipulation of the ball projection apparatus.

In lateral view (FIG. 1) impact arm 3 extends substantially radially from shaft 4 and is angled in the direction of projection in order that an impact plate 2 at its extreme end shall hit ball 13 along a line essentially below the centre of the ball, thereby applying to the ball an impulse which is considered most convenient. It is realized that the movement of the impact arm and the application of the impulse substantially correspond to those conditions which exist when a man kicks a ball with his foot. In FIG. 2 it is seen that the extreme end of the impact arm 3 also is laterally angled for permitting sufficient space for the ball 13 in relation to cocking device 7.

Cocking device 7 is supported by frame 11 and is shown as having two wheels 8, 8' rotatably journalled in frame 11. Said wheels are both driven by a drive means M3 over a now shown transmission, preferably a gear reduction set or a worm reduction gear. For purpose of simplicity wheels 8, 8' are disclosed without their bearing means and support means. Their shafts of rotation are horizontal and placed side by side. At the periphery of each wheel a pin 9, 9' is mounted and is arranged to slidingly fit into and ride in a guide track 35 along at least a portion of impact arm 3.

In the illustrated embodiment guide track 35 is implemented in a most simple way as a flange projecting from impact arm 3 lateral to its extension, but can of course be implemented in other ways.

Pin 9 or wheel 8 is adapted to enter guide track 35 and bear against its flange when impact arm 3 is in its rest position II adjacent to a bumper means 15, preferably being comprised of a block of hard-pressed foamed plastic. During the rotation of wheel 8 in the direction of arrow 37, pin 9 by cooperation with the guiding track and sliding therein brings said impact arm counterclockwise (FIG. 1) against the action of spring 6 to an intermediate position, where pin 9' during the rotation of wheel 8' in the direction of arrow 38 enters guide track 35 and succeed the continued bring-back movement of said impact arm, while pin 9 leaves said guide track. When pin 9' during the movement of wheel 8' has reached the extended position I it leaves the guide track thereby releasing the impact arm which will swing back towards the rest position II and then in an intermediate position shown in full lines kicks out ball 13 in the instant direction of projection Z.

Pins 9, 9' preferably have a rotatably journalled roll at their free-ends engaging said guide track. The friction between the respective pin and the guide track thereby being considerably reduced.

Ball retaining means 53 is arranged substantially straight below shaft 4 for holding the ball 13 to be projected in a projection position in relation to the impact plate 2 of the impact arm. Ball retaining means 53 includes a positioning recess or similar for receiving the lower portion of the ball, as well as means 55 for retaining the ball in the position of projection determined by said recess when the frame rotates around the Y-axis. Said retaining means 55 preferably includes two flexible loop members 56 (only one shown in FIGS. 1 and 2) arranged on opposite sides of said ball positioning recess, which members under some bias are arranged to retain a ball in the position of projection.

Said loop members also serve the purpose of decelerating or damping the movement of the ball when the latter by means of said feed means is fed to the position of projection.

Preferably said drive means M1–M3 mentioned above and the optional drive means for said spring bias means 6, are electrical motors and in FIG. 3 an electrical conductor 59 is shown connected to an input 58 in the junction box for connecting the projecting apparatus to a not shown electrical power source. However, said drive means can also by hydraulic or pneumatic motors and/or include hydraulic or pneumatic cylinder-piston assemblies.

In FIG. 3 the projection apparatus is shown placed in front of a football goal 60 for the training of a goalkeeper. Then the frame work 30 has been coarsely aimed towards the goal, whereafter the switches 27, 27' and 28, 28' for limiting the movement of the frame 11 in height and lateral direction have been manually adjusted such that in the operation of said drive means M1–M3 balls are projected in directions of projections within the frame of the goal 60. According to one form of operation for said projecting means, drive means M1–M3 are arranged to operate continuously such that balls are successively projected against the goal. Since drive means M1 and M2 continuously changes the position of frame 11 in height and lateral direction and so the direction of projection Z, the goalkeeper will not beforehand know to where within the goal frame 60 a ball will be directed. Neither can the goalkeeper by watching the projection apparatus see which direction of projection a ball will have, since the impact means is covered and spaced from the front end of the frame work.

For eliminating the possibility that balls are projected in a determined, repetitive sequence an interval or intermittently acuateable relay or similar means is advantageously provided in at least one of the current supply circuits of said drive means or in the associated control system, which relay more or less irregularly or by chance stops the associated drive means during a short time interval. Owing to this the goalkeeper will never be able to predict a direction of projection Z for a ball to be projected.

In the abovementioned utilization of the projection apparatus an elevated basket 52, shown in FIG. 3, is placed close to the goal. From an opening in said basket a downwards sloping ball transfer track 50 extends towards an opening 54 in said ball projection apparatus, which track connects to said ball feeding means in the apparatus. Owing to this the goalkeeper, after each projection procedure, can throw the ball received into the basket 52, whereupon the ball itself rolls back to the projection apparatus, where a here not closer described receiving and feeding means automatically places a ball in said projection position, as soon as impact arm 3 has been brought back past this position.

According to another embodiment basket 52 can be located on top of the projection apparatus, the ball transfer track 50 then being curved down to the opening 54. This embodiment is particularly advantageous when the projection apparatus is utilized for corner kicks and kicks at goal.

In FIG. 3 also three press button units S1–S3 are shown lying in front of the goal, each of which units is provided with a switch which is actuatable by operation of the press button unit. The press button units are connected to outputs in the junction box 64 over a respective conductor 63. Each output, possibly over the control system, is connected to the power supply circuit of a drive means M1,M2 or M3 such that the goalkeeper himself or any person by means of the press button units S1–S3 can stop one or several drive means in order to interrupt the operation of the impact means or only interrupt the change of direction in height or alternatively in lateral direction, or even to freeze the direction of projection. The latter case is desirable when the projection apparatus is utilized over a large distance, e.g. for performing corner kicks or kicks at goal.

The projection apparatus according to the invention permits automatic projection of balls with great accuracy. The apparatus can be adjusted for delivering balls in a single direction of projection or with variations in side and/or in height within a desired sector area.

Figure 4:
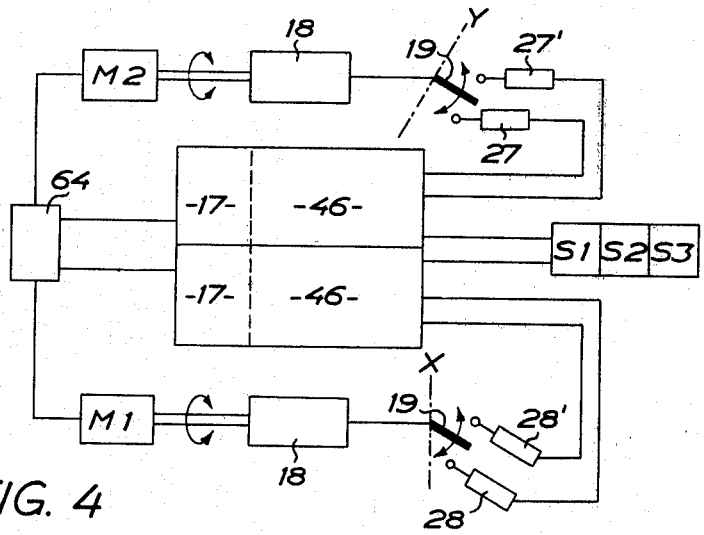
FIG. 4 is a block diagram of the direction adjusting systems in the apparatus according to the invention.

FIG. 4 is a block diagram illustrating the above described direction adjusting device. The two systems for rotation of the impact device around the X-axis and the Y-axis have identical structure, and so only the system for rotation around the X-axis is described in detail. The limit switches 28, 28', which independently are manually displacable by means of levers (not shown), are actuatable by part of frame 11—here referenced 19. Motor M1 is powered from the junction box 64 and via a transmission 18 rotates the frame of the impact device around the vertical X-axis. Limit switches 28, 28' are connected to the control unit 46 which in turn is connected to the junction box 64 for controlling the motor. In control unit 46 a device 17 is incorporated for variable operation of motor M1. As previously mentioned this device can be based on an interval relay or similar means which interrupts the powering of the motor. However, said device alternatively can comprise other types of means which permit variable operation of a motor. Preferably said device providing variable operation of motor M1 is arranged for simple bridging.

The remote control device including switches S1–S3 is also shown connected to the control unit 46.

Figure 5:
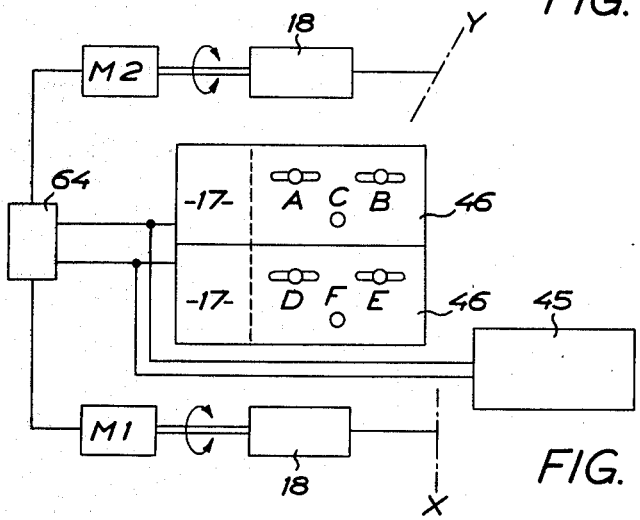
FIG. 5 is a block diagram of a modified structure of the direction adjusting systems according to the invention.

FIG. 5 is a block diagram illustrating an alternative structure of the direction adjusting device. Also here the two systems for rotation of frame 11 the X and Y-axes are identical. The system for rotation around the X-axis includes motor M1 which in the same way as in FIG. 4 is powered from junction box 64 and over a transmission 18 rotates frame 11 around the X-axis. A control unit 46 is provided with an associated device 17 of the above-mentioned kind for variable operation. However, in this case the control unit lacks feedback from the limit switches but is provided with two sub units which are based upon time relays, tachometers or similar means for limiting the rotation of motor M1 and so the rotation of the impact device around the X-axis to the right or to the left. Said sub units are manupulated on a panel having slidable displaceable knobs D and E, respectively, which are connected to potentiometers in the respective sub units. Moreover, a stop button F is provided by which motor M1 can be stopped. In the system for rotation of the frame of the impact device around the Y-axis similar adjustment sub units are provided having knobs A and B for the adjustment of an upper end position and a lower end position, as well as a button C for stopping motor M2.

A further developed projection apparatus can be provided with a program means 45 which is adapted to aim or adjust the impact device into predetermined directions in sequence. As shown in FIG. 5 program means 45 bridges the limit positioning devices of the control units 45 and the units 17 for variable operation. Of course this bridging can be made inside the control units 46. Said program means 45 can be implemented as a fixed program means having adjustment means for adjusting the impact means to take determined directions or projection in sequence. However, said program means can also be provided with a punch card reader in order to generate a desired sequence of aiming positions for the impact device in response to a punch card.

I claim:

1. Apparatus for projecting balls, including a frame an impact device (10) supported in said frame (11) and provided with means to convey to a ball to a location on the frame for projection, the frame (11) being supported in a frame-work (30) for movement around a vertical axis (X) and a horizontal axis (Y), a first drive means (M1) is provided to rotate the frame (11) around said vertical axis (X) in two different horizontal directions in horizontal plane, a second drive means (M2) rotates said frame (11) around said horizontal axis (Y) in two different vertical directions, an underlying support (23) aids in rotation of the frame about the horizontal and vertical axes, the first and the second drive means (M1, M2) rotate the frame over an adjustable angular arc, there being provided limit means (27, 27' and 28, 28') are for limiting the movement of the frame (11) around the vertical axis (X) and the horizontal axis (Y) to mark the end positions for the impact device (10), said limit means being coupled to a respective drive means (M1, M2) and upon actuation is adopted to cause the frame to reverse its direction of movement and said limit means are displaceably supported for variation of the angular arcs in horizontal and vertical direction over which the frame is moveable.

2. Apparatus according to claim 1, characterized in that said limit means (27, 28', 28, 28') are comprised of switches provided to reverse the respective associated drive means (M1, M2).

3. Apparatus as claimed in any one of claims 2 or 1, characterized in that said drive means are electrical motors (M1, M2).

4. Apparatus as claimed in claim 1, characterized in that each drive means has a motor (M1, M2) and a transmission for rotation of said frame (11) around a respective axis (X, Y), and that each motor (M1, M2) has a control system (46) including adjustable means (A–F) for limiting the respective angular arc for the movement of said frame (11).

5. Apparatus as claimed in claim 4, characterized in that said adjustable means (A–F) are manually adjustable.

6. Apparatus as claimed in claim 4, characterized by including program means (45) for actuating said drive means (M1, M2) to position said frame (11) in a sequence of predetermined directions.

7. Apparatus as claimed in any one of claims 2 or 4 to 6; characterized in that said impact device (10) includes a rotatable impact arm (3), spring means (5) connected to said impact arm, and a cocking device (7) which is operable by means of third drive means (M3), said cocking device (7) being provided to cock said impact arm (3) against the action of said spring means (5) from a rest position (II) to a predetermined extended release position (I).

8. Apparatus as claimed in any one of claims 2 or 4 to 6, characterized by including at least one switch (S1–S3) placed at a distance from said apparatus and being connected thereto for controlling at least one of said drive means, (M1, M2, M3).

9. Apparatus according to claim 1, characterized in that each drive means has a motor (M1, M2) and a transmission for rotation of said frame (11) around a respective axis (X, Y), and that each motor (M1, M2) has a control system (46) including adjustable means (A–F) for limiting the respective angular arc for the movement of said frame (11).

10. Apparatus according to claim 1 characterized by at least one rotatable member (22), which rotatable member is movable along a circular path on said underlying support, and is capable of rotating the frame about the vertical axis, and a cable-and-pulley arrangement (24–26) which is capable of moving the plate up and down, for rotating the frame about the horizontal axis.

* * * * *